US007467617B2

(12) United States Patent
Irisawa

(10) Patent No.: US 7,467,617 B2
(45) Date of Patent: Dec. 23, 2008

(54) FUEL INJECTION APPARATUS AND FUEL INJECTION CONTROL METHOD FOR INTERNAL COMBUSTION ENGINE

(75) Inventor: Yasuyuki Irisawa, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 197 days.

(21) Appl. No.: 10/588,273

(22) PCT Filed: Mar. 10, 2005

(86) PCT No.: PCT/IB2005/000599

§ 371 (c)(1),
(2), (4) Date: Aug. 4, 2006

(87) PCT Pub. No.: WO2005/090776

PCT Pub. Date: Sep. 29, 2005

(65) Prior Publication Data

US 2007/0169746 A1 Jul. 26, 2007

(30) Foreign Application Priority Data

Mar. 15, 2004 (JP) ..... 2004-072731

(51) Int. Cl.
*F02B 15/00* (2006.01)

(52) U.S. Cl. ..... 123/431; 123/295

(58) Field of Classification Search ..... 123/294, 123/295, 431

See application file for complete search history.

(56) References Cited

U.S. PATENT DOCUMENTS 5,924,405 A * 7/1999 Hashimoto ..... 123/431
2002/0007816 A1 1/2002 Loye et al.
2002/0017269 A1 2/2002 Loye et al.
2002/0020388 A1 2/2002 Wright et al.
2003/0168037 A1 9/2003 Loye et al.
2004/0040692 A1 3/2004 Pin-Hung
2004/0149255 A1 8/2004 Loye et al.

FOREIGN PATENT DOCUMENTS

JP A-63-138118 6/1988
JP A 63-154816 6/1988
JP A 05-231221 9/1993
JP A 07-103019 4/1995
JP A 07-103049 4/1995
JP A-07-197833 8/1995
JP A 10-103118 4/1998
JP A 11-303669 11/1999

* cited by examiner

*Primary Examiner*—Erick Solis
(74) *Attorney, Agent, or Firm*—Oliff & Berridge, PLC

(57) ABSTRACT

A fuel injection apparatus and a fuel injection control method for an internal combustion engine which performs a direct injection operation for injecting fuel from an injector for cylinder injection into a cylinder and a port injection operation for injecting fuel from an injector for intake port injection into an intake port. When a request to change from fuel injection from the injector for cylinder injection to fuel injection from the injector for intake port injection is made, the fuel injection mode of a particular cylinder is changed at a point of time according to the changing request for the particular cylinder. Accordingly, transition to the optimum fuel injection mode is performed in a short time, and a required amount of air-fuel mixture can be obtained. It is therefore possible to suppress fluctuation of torque and deterioration of emission.

8 Claims, 7 Drawing Sheets

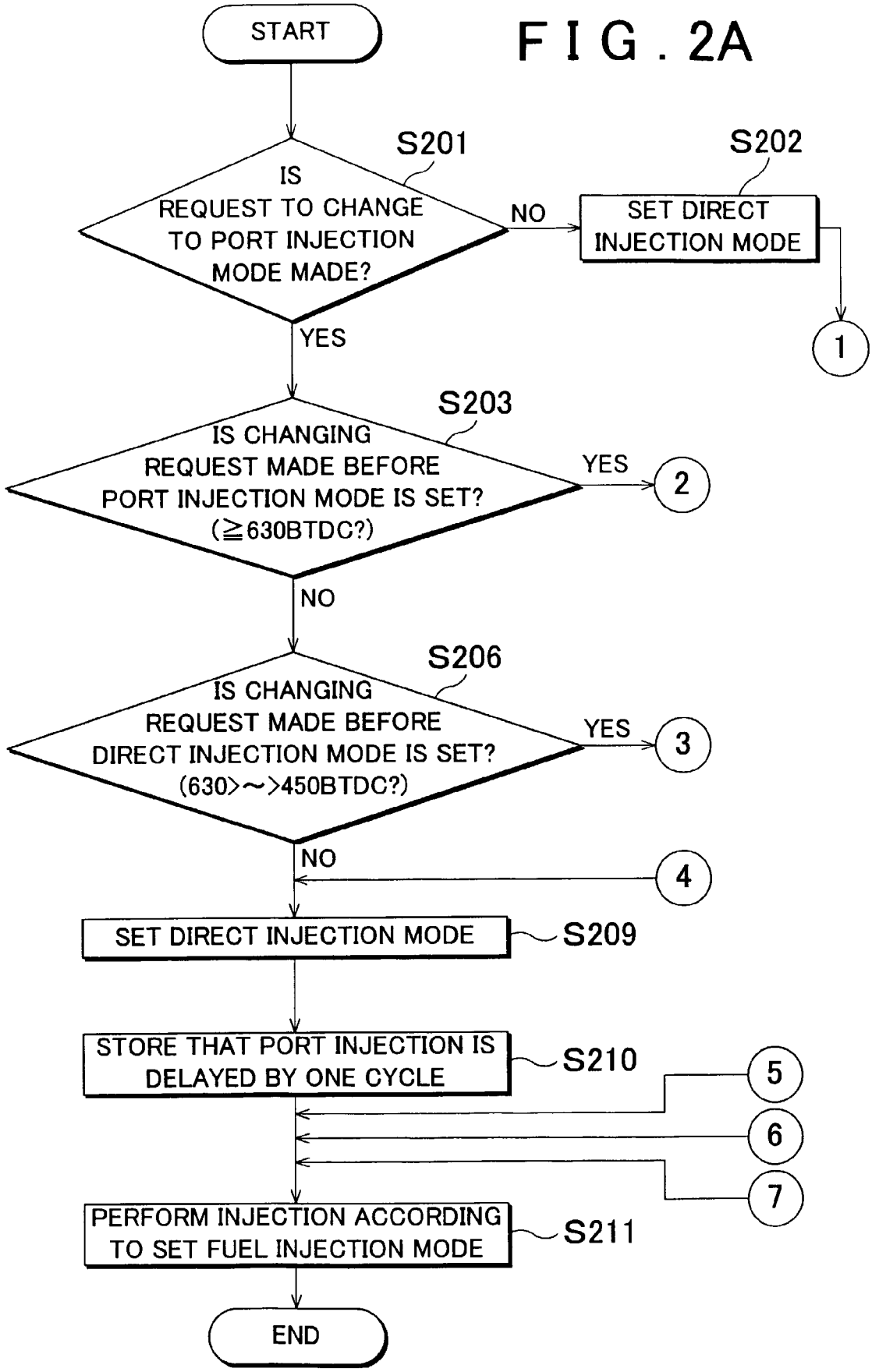
START
FIG. 2A
S201
IS REQUEST TO CHANGE TO PORT INJECTION MODE MADE?
NO
S202
SET DIRECT INJECTION MODE
1
YES
S203
IS CHANGING REQUEST MADE BEFORE PORT INJECTION MODE IS SET? (≧630BTDC?)
YES
2
NO
S206
IS CHANGING REQUEST MADE BEFORE DIRECT INJECTION MODE IS SET? (630>~>450BTDC?)
YES
3
NO
4
SET DIRECT INJECTION MODE
S209
STORE THAT PORT INJECTION IS DELAYED BY ONE CYCLE
S210
5
6
7
PERFORM INJECTION ACCORDING TO SET FUEL INJECTION MODE
S211
END

FUEL INJECTION APPARATUS AND FUEL INJECTION CONTROL METHOD FOR INTERNAL COMBUSTION ENGINE

The disclosure of Japanese Patent Application No. 2004-072731 filed on Mar. 15, 2004, including the specification, drawings and abstract is incorporated herein by reference in its entirety.

BACKGROUND OF THE INVENTION

1. Field of the Invention

The invention relates to a fuel injection apparatus and a fuel injection control method for an internal combustion engine. More particularly, the invention relates to a fuel injection apparatus and a fuel injection control method for a dual injection type internal combustion engine which includes an injector for cylinder injection that injects fuel into a cylinder, and an injector for intake port injection that injects fuel into an intake port.

2. Description of the Related Art

A dual injection type internal combustion engine is known which includes an injector for cylinder injection that injects fuel into a cylinder and an injector for intake port injection that injects fuel into an intake port. In this dual injection type internal combustion engine, one of these injectors is selected and used depending on an operation region of an engine, stratified combustion or homogenous combustion is performed, and both of the injectors are used in a predetermined operation region.

As an example of a fuel injection apparatus for such a dual injection type internal combustion engine, Japanese Patent Laid-Open Publication No. 10-103118 discloses a fuel injection apparatus which includes an injector for intake port injection and an injector for cylinder injection. This fuel injection apparatus suppresses fluctuation of an air-fuel ratio, which occurs when the injector is changed, by setting the ratio of an amount of fuel to be injected into the cylinder in consideration of a time lag of fuel supply by port injection.

However, Japanese Patent Laid-Open Publication No. 10-103118 discloses only that the fuel injection apparatus appropriately sets an amount of fuel injected from the injector for cylinder injection and an amount of fuel injected from the injector for intake port injection in order to suppress fluctuation of an air-fuel ratio which occurs when the fuel injection injector is changed. There is no description concerning fuel injection timing in Japanese Patent Laid-Open Publication No. 10-103118.

In a dual injection type internal combustion engine in which the combustion mode is changed depending on an operation region, for example, in an engine in which the combustion mode is changed to the stratified lean combustion mode, the homogeneous lean combustion mode, the homogeneous stoichiometric combustion mode, or the like, basically, fuel is injected from only one of an injector for cylinder injection and an injector for intake port injection. In this case, it is considerably important how to set the fuel injection timing. When a request to change the combustion mode, that is, a request to change the fuel injector is made due to transition of the operation region, fuel injection timing is limited concerning a particular cylinder and the fuel injection timing cannot be set to the requested fuel injection timing, depending on the point of time at which the request to change the combustion mode is made. As a result, the optimum fuel injection mode and the optimum air-fuel ratio cannot be realized, which causes problems such as fluctuation of torque and deterioration of emission.

SUMMARY OF THE INVENTION

The invention is made in the light of the above-mentioned circumstances. It is therefore the object of the invention to provide a fuel injection apparatus and a fuel injection control method for an internal combustion engine, which can suppress fluctuation of torque and deterioration of emission.

According to an aspect of the invention, there is provided a fuel injection apparatus for an internal combustion engine which performs a direct injection operation for injecting fuel from an injector for cylinder injection into a cylinder and a port injection operation for injecting fuel from an injector for intake port injection into an intake port. In this fuel injection apparatus for an internal combustion engine, when a request to change a fuel injection mode from a mode of fuel injection from the injector for cylinder injection to a mode of fuel injection from the injector for intake port injection is made, the fuel injection mode of a particular cylinder is changed at a point of time according to the request to change the fuel injection mode for the particular cylinder.

According another aspect of the invention, there is provided a fuel injection control method for an internal combustion engine which performs a direct injection operation for injecting fuel from an injector for cylinder injection into a cylinder and a port injection operation for injecting fuel from an injector for intake port injection into an intake port. In this fuel injection control method for an internal combustion engine, when a request to change a fuel injection mode from a mode of fuel injection from the injector for cylinder injection to a mode of fuel injection from the injector for intake port injection is made, the fuel injection mode of a particular cylinder is changed at a point of time at according to the request to change the fuel injection mode for the particular cylinder.

According to the above-mentioned fuel injection apparatus and fuel injection control method for an internal combustion engine, in the internal combustion engine which performs the direct injection operation for injecting fuel from the injector for cylinder injection into the cylinder and the port injection operation for injecting fuel from the injector for intake port injection into an intake port, when a request to change the fuel injection mode from the mode of fuel injection from the injector for cylinder injection to the mode of fuel injection from the injector for intake port injection is made, the fuel injection mode of a particular cylinder is changed at a point of time according to the request to change the combustion mode for the particular cylinder. Accordingly, transition of the fuel injection mode to the optimum fuel injection mode is performed in a short time, and a required amount of air-fuel mixture can be obtained. As a result, it is possible to suppress fluctuation of torque and deterioration of emission.

In the case where the request to change the fuel injection mode is made before the fuel injection mode is set to a port injection mode, the fuel injection mode may be changed to a mode of fuel injection from the injector for intake port injection simultaneously with the request to change the fuel injection mode.

In the case where the request to change the fuel injection mode is made during a period after the port injection mode is set and before the direct injection mode is set, when the requested port injection mode is an intake synchronous injection mode, the fuel injection mode may be changed to the mode of fuel injection from the injector for intake port injection simultaneously with the request to change the fuel injection mode. When the requested port injection mode is an intake non-synchronous injection mode, the fuel injection mode may be changed to the mode of fuel injection from the injector for intake port injection after one cycle has elapsed since the request to change the fuel injection mode is made.

In the case where the request to change the fuel injection modes is made after the port injection mode and the direct injection mode are set, the fuel injection mode may be changed to the mode of fuel injection from the injector for intake port injection after one cycle has elapsed since the request to change the fuel injection mode is made.

According to another aspect of the invention, there is provided a fuel injection apparatus for an internal combustion engine which performs a direct injection operation for injecting fuel from an injector for cylinder injection into a cylinder and a port injection operation for injecting fuel from an injector for intake port injection into an intake port. In the fuel injection apparatus for an internal combustion engine, when a fuel injection mode is changed from a mode of fuel injection from the injector for cylinder injection to a mode of fuel injection from the injector for intake port injection, the fuel injection mode is set to an intake synchronous injection mode until an amount of fuel adhering to a wall surface of the intake port due to port injection becomes stable.

According to another aspect of the invention, there is provided a fuel injection control method for an internal combustion engine which performs a direct injection operation for injecting fuel from an injector for cylinder injection into a cylinder and a port injection operation for injecting fuel from an injector for intake port injection into an intake port. In the fuel injection control method for an internal combustion engine, when the fuel injection mode is changed from the mode of fuel injection from the injector for cylinder injection to the mode of fuel injection from the injector for intake port injection, the fuel injection mode is set to an intake synchronous injection mode until an amount of fuel adhering to a wall surface of the intake port due to port injection becomes stable.

According to the above-mentioned fuel injection apparatus and the fuel injection control method for an internal combustion engine, in the internal combustion engine which performs the direct injection operation for injecting fuel from the injector for cylinder injection into the cylinder and the port injection operation for injecting fuel from the injector for intake port injection into the intake port, when the fuel injection mode is changed from the mode of fuel injection from the injector for cylinder injection to the mode of fuel injection from the injector from the intake port injection, the fuel injection mode is set to the intake synchronous injection mode until the amount of fuel adhering to the wall surface of the intake port due to port injection becomes stable. Accordingly, a stable air-fuel mixture can be obtained without being affected by the fuel adhering to the wall surface. As a result, it is possible to suppress fluctuation of torque and deterioration of emission.

BRIEF DESCRIPTION OF THE DRAWINGS

The above-mentioned and other features, advantages, technical and industrial significance of this invention will be better understood by reading the following detailed description of preferred embodiments of the invention, when considered in connection with the accompanying drawings, in which:

FIGS. 2A and 2B are flowcharts showing an example of the fuel injection apparatus and fuel injection control method according to the first embodiment of the invention;

DETAILED DESCRIPTION OF THE PREFERRED EMBODIMENTS

In the following description and the accompanying drawings, the present invention will be described in more detail in terms of exemplary embodiments.

Figure 1:
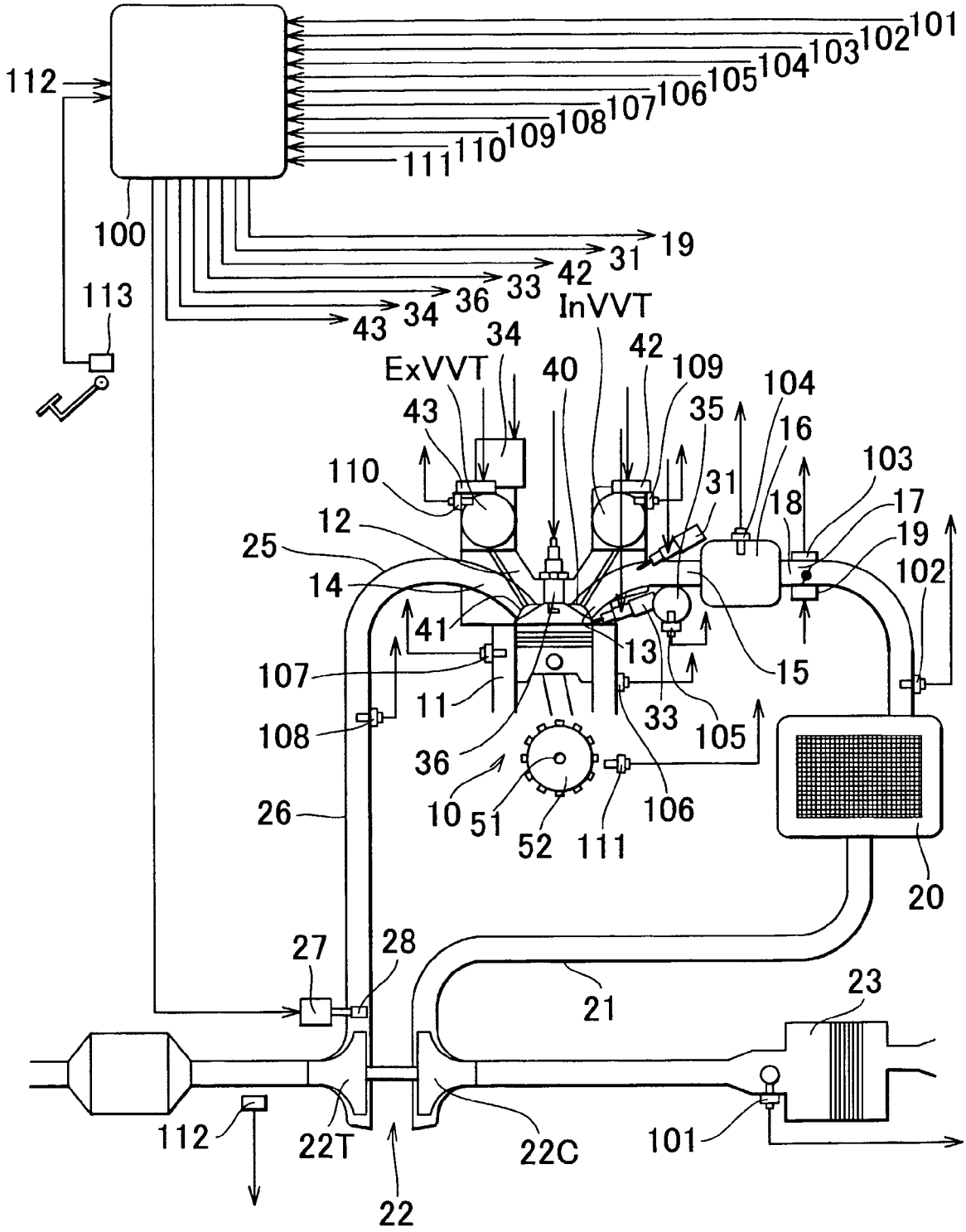
FIG. 1 is a view schematically showing a structure of an internal combustion engine to which a fuel injection apparatus and fuel injection control method is applied according to a first or a second embodiment of the invention.

First, an entire structure of a dual injection type internal combustion engine having a supercharger, to which a fuel injection apparatus according to a first or a second embodiment of the invention is applied, will be described with reference to FIG. 1. In FIG. 1, a reference numeral "10" signifies an engine having a variable valve timing mechanism and a supercharger (hereinafter, simply referred to as an "engine"). In FIG. 1, the reference numeral "10" signifies a gasoline engine having an injector for intake port injection and an injector for cylinder injection. A cylinder head 12 is provided in a cylinder block 11 of the engine 10. In the cylinder head 12, an intake port 13 and an exhaust port 14 are formed for each cylinder.

In an intake system of the engine 10, an intake manifold 15 is communicated with each intake port 13, and a throttle chamber 18 provided with a throttle valve 17 is communicated with the intake manifold 15 via a surge tank 16 in which intake passages of the cylinders are gathered. The throttle valve 17 is driven by a throttle motor 19. An inter-cooler 20 is provided upstream of the throttle chamber 18. The inter-cooler 20 is communicated with a compressor 22C of a turbocharger 22, which is an example of a supercharger, via an intake pipe 21. The inter-cooler 20 is further communicated with an air cleaner 23.

An injector 31 for intake port injection is provided in the intake manifold 15 at a position immediately upstream of the intake port 13 of each cylinder. An injector 33 for cylinder injection, which directly injects fuel into a combustion chamber of each cylinder in the cylinder block 11, is provided in the cylinder head 12. The injector 33 for cylinder injection is communicated with a fuel delivery pipe 35 to which high pressure fuel is supplied from a high pressure fuel pump 34. In addition, a spark plug 36 is provided in each cylinder in the cylinder head 12.

In an exhaust system of the engine 10, exhaust gas is gathered by an exhaust manifold 25 communicated with each exhaust port 14 of the cylinder head 12, and an exhaust pipe 26 is connected to the exhaust manifold 25. A turbine 22T of the turbocharger 22 is provided in the exhaust pipe 26, and a catalyst, a muffler and the like are provided in the exhaust pipe 26 at a position downstream of the turbine 22T. The turbocharger 22 performs supercharging by taking in air and applying pressure to the air, when the compressor 22C is rotationally driven by energy of the exhaust gas flowing in the turbine 22T. A variable nozzle 28 including an actuator 27 for operating a variable nozzle, which is an electric actuator, is provided on an inlet side of the turbine 22T in order to adjust a flow rate and a pressure of the in-flow exhaust gas. With the actuator 27 for operating a variable nozzle, an opening amount of the variable nozzle 28 is adjusted and a supercharging pressure is controlled according to a control signal output from an after-mentioned electronic control unit (hereinafter, referred to as an "ECU") 100.

A variable valve timing mechanism for controlling a valve overlap amount in the engine 10 will be described. As is well known, rotation of a crank shaft 51 of the engine 10 is transmitted to an intake cam shaft and an exhaust cam shaft provided in the cylinder head 12 via a crank pulley, a timing belt, an intake cam pulley, an exhaust cam pulley, and the like which are fixed to the crank shaft 51. The cam shaft is set to rotate once while the crank shaft 51 rotates twice. The intake cam (not shown) provided in the intake camshaft and the exhaust cam (not shown) provided in the exhaust camshaft open/close an intake valve 40 and an exhaust valve 41 based on the rotation of each camshaft which rotates once while the crank shaft 51 rotates twice.

Between the intake camshaft and the intake cam pulley, there is provided a hydraulic variable valve timing mechanism InVVT which continuously changes a rotational phase (displacement angle) of the intake camshaft with respect to the crankshaft 51 by rotating the intake cam pulley and the intake cam shaft with respect to each other. As is well known, in the variable valve timing mechanism InVVT, a hydraulic pressure is changed by an oil control valve 42 including a linear solenoid valve or a duty solenoid valve, and the like. The variable valve timing mechanism InVVT is operated according to a drive signal from the after-mentioned engine-control ECU 100.

Similarly, between the exhaust camshaft and the exhaust cam pulley, there is provided a variable valve timing mechanism ExVVT which continuously changes a rotational phase (displacement angle) of the exhaust camshaft with respect to the crankshaft 51 by rotating the exhaust cam pulley and the exhaust camshaft with respect to each other. As in the case of the variable valve timing mechanism InVVT on the intake side, in the variable valve timing mechanism ExVVT, a hydraulic pressure is changed by an oil control valve 43. The variable valve timing mechanism ExVVT is operated according to a drive signal from the after-mentioned engine-control ECU 100.

Next, various sensors for detecting an engine operation state will be described. In the intake pipe 21, an air flow meter 101 is provided immediately downstream of the air cleaner 23, and a temperature sensor 102 is provided immediately downstream of the inter-cooler 20. There is provided a throttle position sensor 103 which detects an opening amount of the throttle valve 17 that is provided in the throttle chamber 18 and that is used for adjusting an amount of air. Also, an intake pipe pressure sensor 104 is provided in the surge tank 16. In addition, a fuel pressure sensor 105 for detecting a fuel pressure is attached to the fuel delivery pipe 35. A knocking sensor 106 is attached to the cylinder block 11 of the engine 10. A coolant temperature sensor 107 is provided in the cylinder block 11. Also, a back pressure sensor 108 is provided downstream of a join portion at which the exhaust manifold 25 joins the exhaust pipe 26.

As a sensor for detecting an operation position of the variable valve timing mechanism InVVT on the intake side, an intake side cam position sensor 109, which detects plural protrusions formed, at regular intervals, on the periphery of the cam rotor that is fixed to the intake cam shaft and that rotates in synchronization with the intake cam shaft and which outputs a cam position pulse indicating a position of the cam, is provided in the variable valve timing mechanism InVVT. Similarly, as a sensor for detecting an operation position of the variable valve timing mechanism ExVVT on the exhaust side, an exhaust side cam position sensor 110, which detects plural protrusions formed, at regular intervals, on the periphery of the cam rotor that is fixed to the exhaust cam shaft and that rotates in synchronization with the exhaust cam shaft and which outputs a cam position pulse indicating a position of the cam, is provided in the variable valve timing mechanism ExVVT on the exhaust side. Also, there is provided a crank position sensor 111 which detects protrusions formed, at regular intervals, on the periphery of a crank rotor 52 that is attached to the crankshaft 51 and that rotates in synchronization with the crankshaft 51 and which outputs a crank pulse indicating a crank angle. In addition, an air-fuel ratio sensor 112 is provided downstream of the turbine 22T of the turbocharger 22. A reference numeral "113" signifies an accelerator pedal operation amount sensor which generates output voltage proportional to the depression amount of an accelerator pedal.

In FIG. 1, the reference numeral "100" signifies the electronic control unit (hereinafter, referred to as the "ECU"). The ECU 100 processes signals transmitted from the above-mentioned various sensors, computes control amounts for various actuators, and performs fuel injection control, ignition timing control, idle speed control, supercharging pressure control, valve timing control for the intake valve and the exhaust valve, and the like. The ECU 100 mainly includes a microcomputer in which a CPU, ROM, RAM, backup RAM, a counter timer group, an I/O interface and the like are connected to each other via a bus line. In the ECU 100, a constant voltage circuit for supplying a stabilized power supply to various portions, a drive circuit connected to the I/O interface, and a peripheral circuit for an A/D converter and the like are embedded. An input port of the I/O interface is connected to the air flow meter 101, the temperature sensor 102, the throttle position sensor 103, the intake pipe pressure sensor 104, the fuel pressure sensor 105, the knocking sensor 106, the coolant temperature sensor 107, the back pressure sensor 108, the cam position sensors 109 and 110, the crank position sensor 111, the air-fuel ratio sensor 112, the accelerator pedal operation amount sensor 113, a vehicle speed sensor for detecting a vehicle speed, and the like.

Meanwhile, an output port of the I/O interface is connected, via the drive circuit, to the throttle motor 19, the actuator 27 for operating a variable nozzle, the injector 31 for intake port injection, the injector 33 for cylinder injection, the high pressure pump 34, the spark plug 36, the oil control valves 42 and 43.

The ECU 100 processes signals, which are detected by the various sensors and which are input via the I/O interface, according to a control program stored in the ROM, and performs engine operation control such as fuel injection amount and timing control, ignition timing control, air-fuel ratio feedback control, supercharging pressure control, and valve timing control based on fixed data such as various data stored in the RAM, various learning value data stored in the backup RAM, and a control map an the like stored in the ROM.

Figure 3:
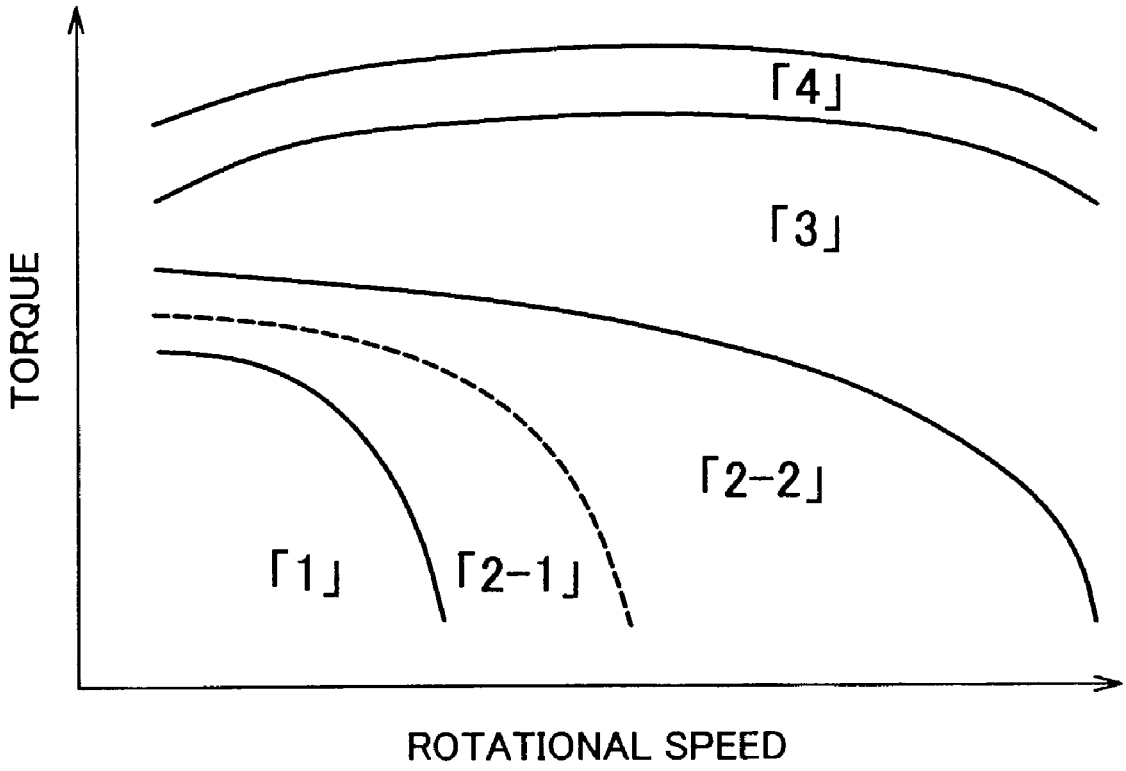
FIG. 3 is a graph showing regions of combustion modes corresponding to operation conditions in the first and the second embodiments of the invention.

A description will be made concerning an example of combustion modes corresponding to the operation regions in the engine to which the embodiment is applied, with reference to FIG. 3. In the embodiment, under the operation condition using torque corresponding to an engine load and a rotational speed (speed) as parameters, there are a stratified lean region "1" corresponding to the operation condition where the speed is low and the load is low; a homogenous lean region "2" corresponding to the operation condition where the speed is medium or high and the load is medium or low; a homogenous stoichiometric region "3" corresponding to the operation condition where the load is medium; and a homogenous WOT region "4" corresponding the operation condition where the load is high. Further, the homogenous lean region "2" is divided into an intake synchronous injection region "2-1" which is closer to the stratified lean region "1", and an intake non-synchronous injection region "2-2" which is closer to the homogenous stoichiometric region "3". In the stratified lean region "1", stratified lean combustion is performed by direct injection from the injector 33 for cylinder injection during the compression stroke. In the intake synchronous injection region "2-1", fuel injection from the injector 31 for intake port injection is performed in substantial synchronization with the intake stroke. In the intake non-synchronous injection region "2-2", fuel injection from the injector 31 for intake port injection is performed during a stroke different from the intake stroke (e.g., exhaust stroke). In the homogenous stoichiometric region "3", intake non-synchronous injection from the injector 31 for intake port injection is performed. In the homogenous WOT region "4", intake non-synchronous injection from the injector 31 for intake port injection and direct injection from the injector 33 for cylinder injection are performed simultaneously.

Figure 2B:
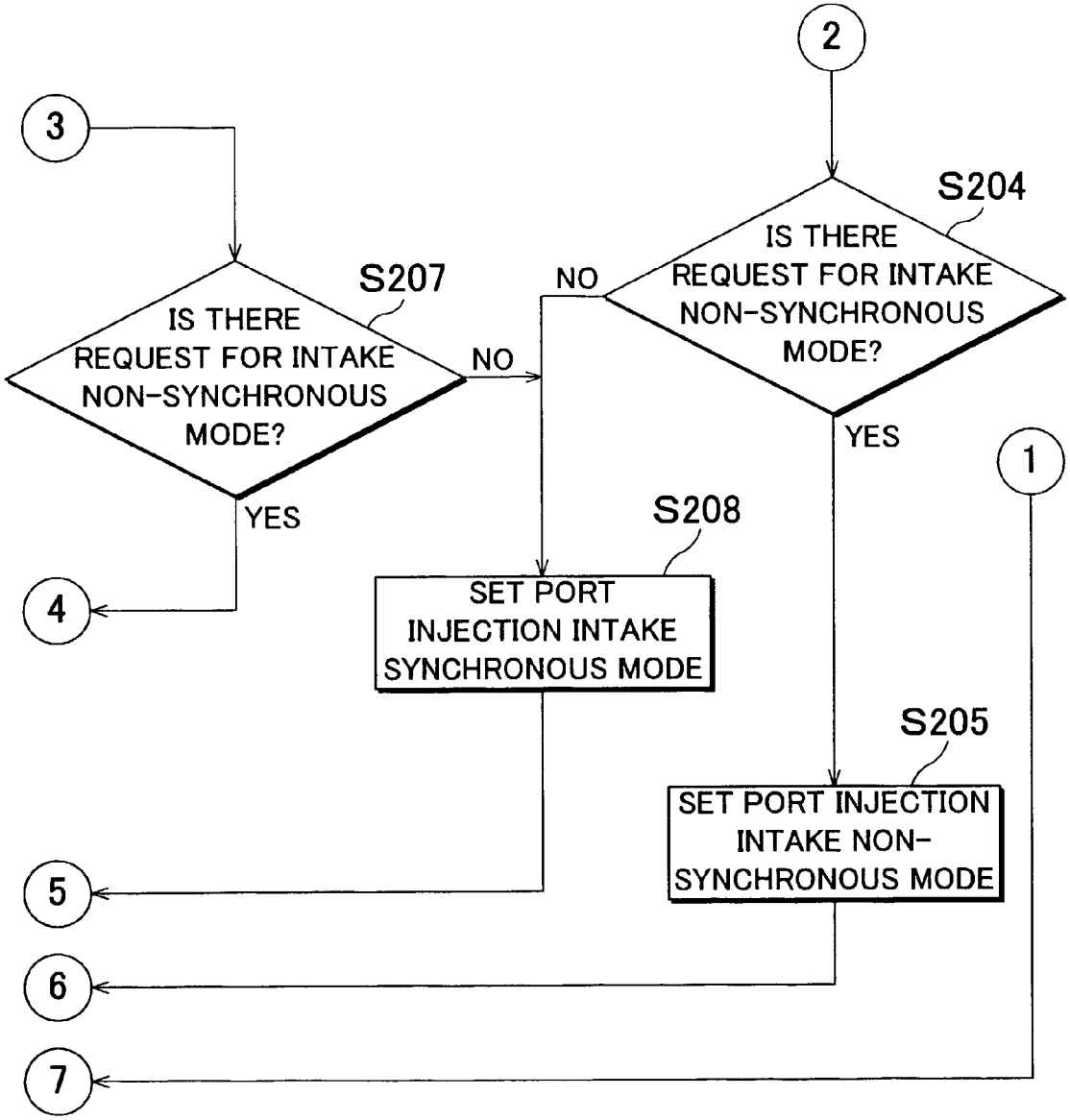

Next, a description will be made concerning an example of a control routine of the control method of the fuel injection apparatus according to the first embodiment in the thus configured engine, with reference to flowcharts in FIGS. 2A and 2B. The control routine is performed, as a part of the regular control routine for performing controlling for realizing the optimum engine state, for each 180° rotation of the crankshaft 51. The regular control includes fuel injection control in which the fuel injection amount and timing are obtained based on an engine rotational speed and an engine load obtained based a signal from one of the air flow meter 101, the intake pipe pressure sensor 104 and the accelerator pedal operation amount sensor 113 depending on a subject of control; valve overlap amount control in which both the intake valve and the exhaust valve are open by the valve timing control performed via the variable valve timing mechanisms InVVT and ExVVT; supercharging pressure control performed via the turbocharger 22, and the like.

When the control is started, the electronic control unit 100 determines the engine operation state and the requested region based on an engine load detected by the accelerator pedal operation amount sensor 113 and the air flow meter 101 at predetermined intervals, and an engine rotational speed obtained by calculation performed by the crank position sensor 111.

In step S201, it is determined whether there is a request to change the region from the stratified lean region "1", in which direct injection is performed by injecting fuel from the injector 33 for cylinder injection, to the homogenous lean region "2", in which port injection is performed by injecting fuel from the injector 31 for intake port injection, or to the homogenous stoichiometric ($\lambda$=1) region "3". When it is determined in step S201 that a request to change the region has not been made ("NO" in step S201), step S202 is then performed in which the fuel injection mode is set to the direct injection mode in order to continue the direct injection, that is, fuel injection from the injector 33 for cylinder injection. On the other hand, when it is determined in step S201 that there is a request to change the region from the stratified lean region "1" to the homogenous lean region "2" or to the homogenous stoichiometric region "3", namely, a request to change the fuel injection mode from the direct injection mode to the port injection mode has been made, step S203 and the following steps are performed in order to perform a routine for setting a fuel injection mode which can be set for a particular cylinder according to a point of time at which a request to change the fuel injection mode is made for the particular cylinder. Namely, it is determined in step S203 whether the request to change the fuel injection mode is made before the port injection mode is set for the particular cylinder. When it is determined that the request is made before the port injection mode is set for the particular cylinder, step S204 is then performed in which it is determined whether there is a request for the intake non-synchronous injection mode in the intake non-synchronous region "2-2". When an affirmative determination is made in step S204, step S205 is then performed in which the fuel injection mode is set to the port injection intake non-synchronous injection mode as requested. On the other hand, when a negative determination is made in step S204, step S208 is then performed in which the fuel injection mode is set to the port injection intake synchronous mode.

On the other hand, when it is determined in step S203 that the request to change the fuel injection mode is made after the port injection mode is set for the particular cylinder, step S206 is then performed in which it is determined whether the request to change the fuel injection mode is made before the direct injection mode is set. When it is determined in step S206 that the request is made before the direct injection mode is set, step S207 is then performed in which it is determined whether there is a request for the intake non-synchronous injection mode in the intake non-synchronous injection region "2-2". When a negative determination is made in step S207, step S208 is then performed in which the port injection intake synchronous mode is set. On the other hand, when an affirmative determination is made in step S207, step S209 is performed, and the direct injection mode is set. When a negative determination is made in step S206, step S209 is performed in which the direct injection mode is set. In step S210, the information that the port injection is delayed by one cycle is stored. In step S211, furl injection according to the injection mode set in step S205, step S208 or step S209 is performed.

Figure 4:
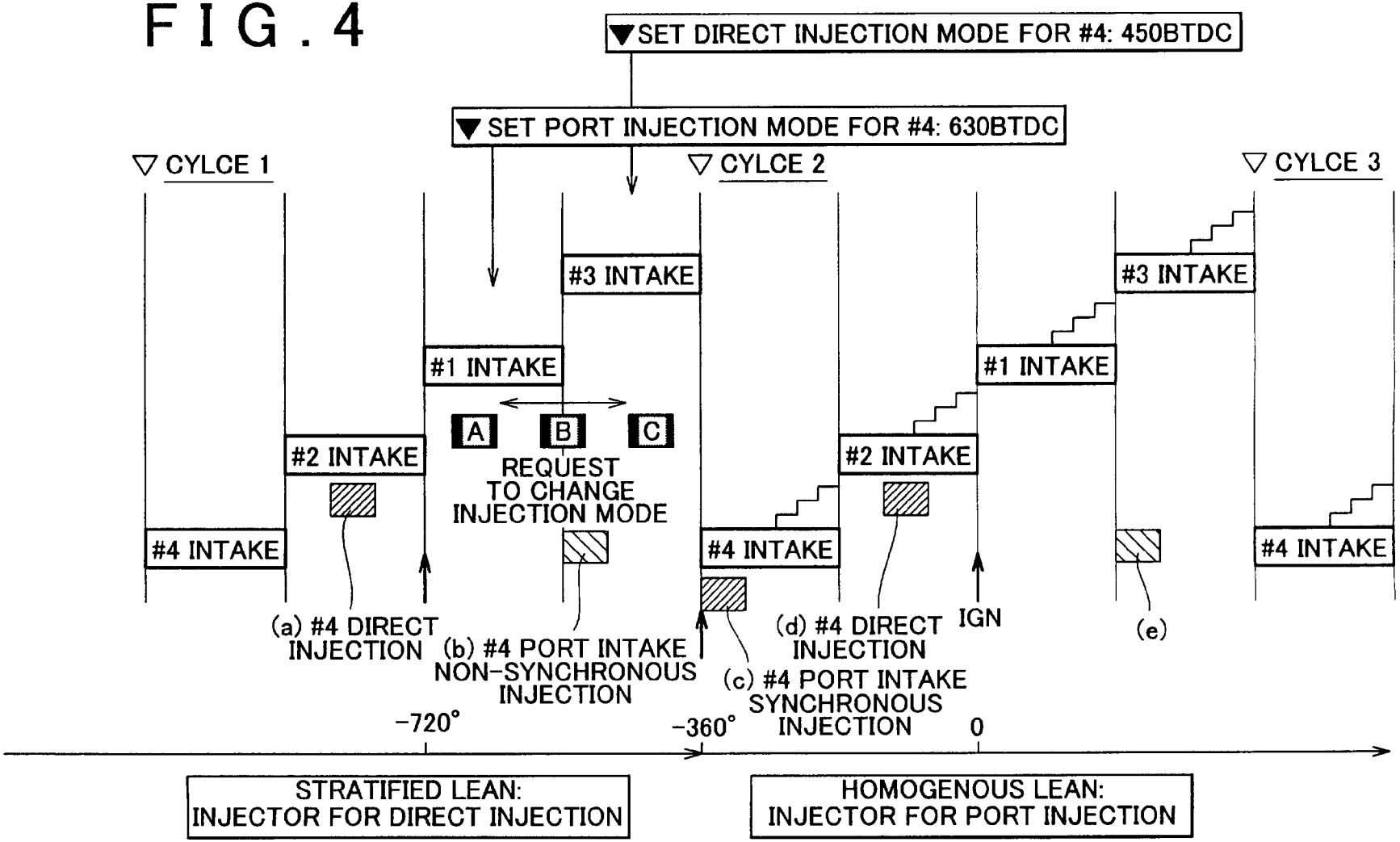
FIG. 4 is a time chart showing a state in which a combustion mode is changed from a stratified lean combustion to a homogeneous lean combustion in the first embodiment of the invention.

The state of change from the direct injection mode to the port injection mode according to the above-mentioned control routine will be described in more detail with reference to a time chart shown in FIG. 4. In this time chart, setting of the fuel injection mode for a cylinder #4 is shown, when the region is changed from the stratified lean region, in which the direct injection is performed by injecting fuel from the injector 33 for cylinder injection, in the cycle 1 shown on the left side to the homogenous lean region, in which the port injection is performed by injecting fuel from the injector 31 for the intake port injection, in a cycle 2 shown on the right side, in the case where ignition of the engine 10 is performed in the order of cylinders 1, 3, 4 and 2. The ING position in the cycle 2 in the time chart in FIG. 4 is the ignition position for the cylinder #4. This position is regarded as 0° (TDC) of the crank angle. In FIG. 4, each of the reference characters (a) and (d) shows direct injection for the cylinder #4; each of the reference characters (b) and (e) shows the port intake non-synchronous injection for the cylinder #4; and the reference character (c) shows the intake synchronous injection for the cylinder #4. Further, each of the reference characters "A", "B", and "C" shows the time at which a request to change the fuel injection mode from the direct injection mode to the port injection mode is made.

If a request to change the fuel injection mode from the direct injection mode to the port injection mode is made at time "A", the port injection mode has not been set for the cylinder #4 (630° BTDC). Accordingly, the port intake non-synchronous injection for the cylinder #4 at (b) or the intake synchronous injection mode for the cylinder #4 at (c) can be set. Therefore, one of the requested fuel injection mode is set, and fuel injection according to the set mode is performed. If a request to change the fuel injection mode is made at time "B", the direct injection mode has not been set for the cylinder #4 (540° BTDC). Accordingly, although the port intake non-synchronous injection mode for the cylinder #4 at (b) cannot be set, the intake synchronous injection mode for the cylinder #4 at (c) can be set. Therefore, when a request to change the fuel injection mode to the synchronous injection mode for the cylinder #4 is made, the requested fuel injection mode is set and performed. However, when a request to change the fuel injection mode to the intake non-synchronous injection mode for the cylinder #4 is made, the requested fuel injection mode is performed in the cycle 3, which is one cycle after the request to change the fuel injection mode is made. If a request to change the fuel injection mode is made at time "C", the direct injection mode has already been set (450° BTDC). Accordingly, the direct injection mode is set, and the direct injection mode for the cylinder #4 at (d) is performed, and the port injection is performed in the cycle 3, which is one cycle after the request to change the fuel injection mode is made.

Figure 5A:
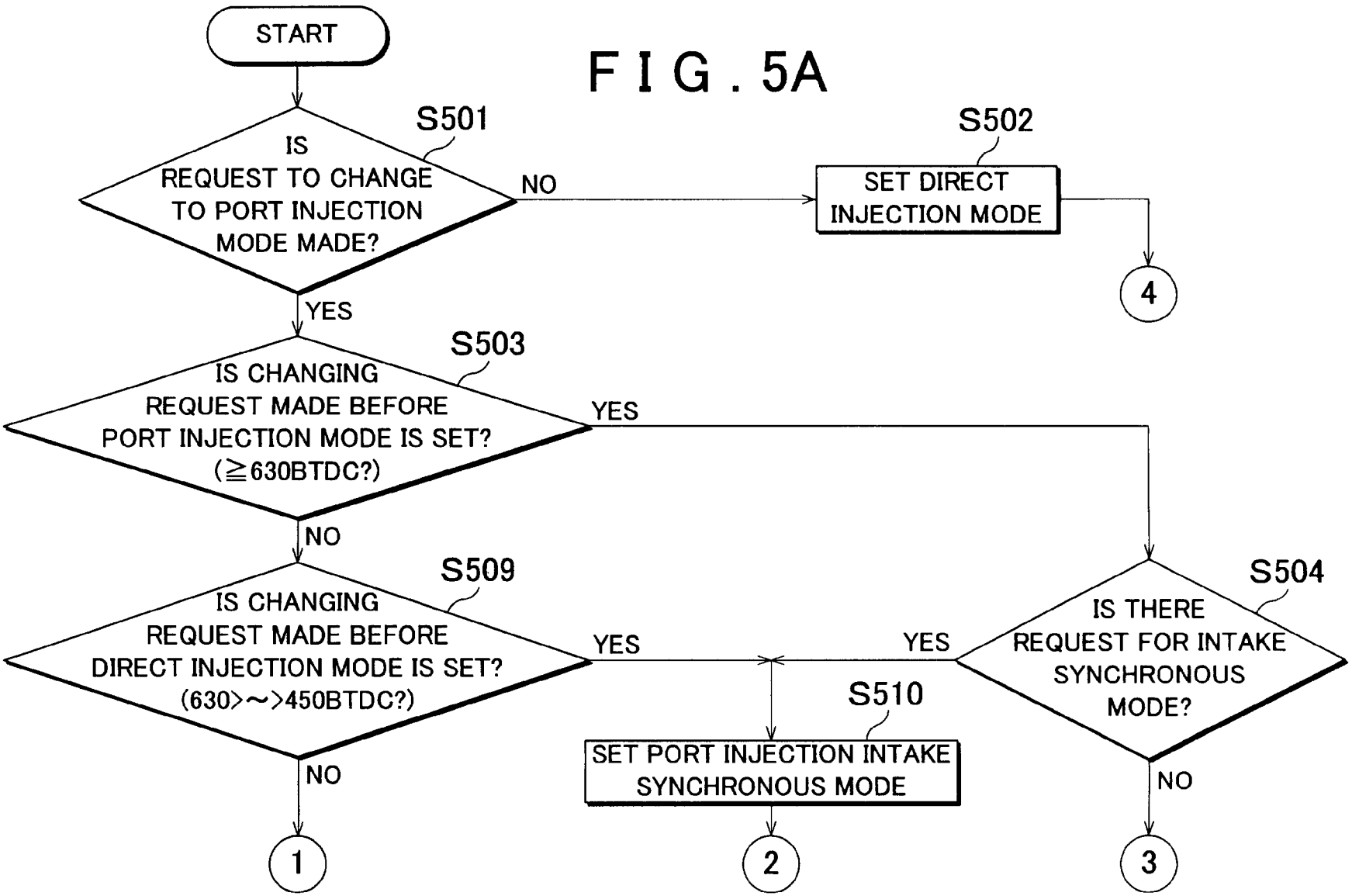
FIGS. 5A and 5B are flowcharts showing an example of fuel injection control according to the fuel injection apparatus and fuel injection control method in the second embodiment of the invention.
Figure 5B:
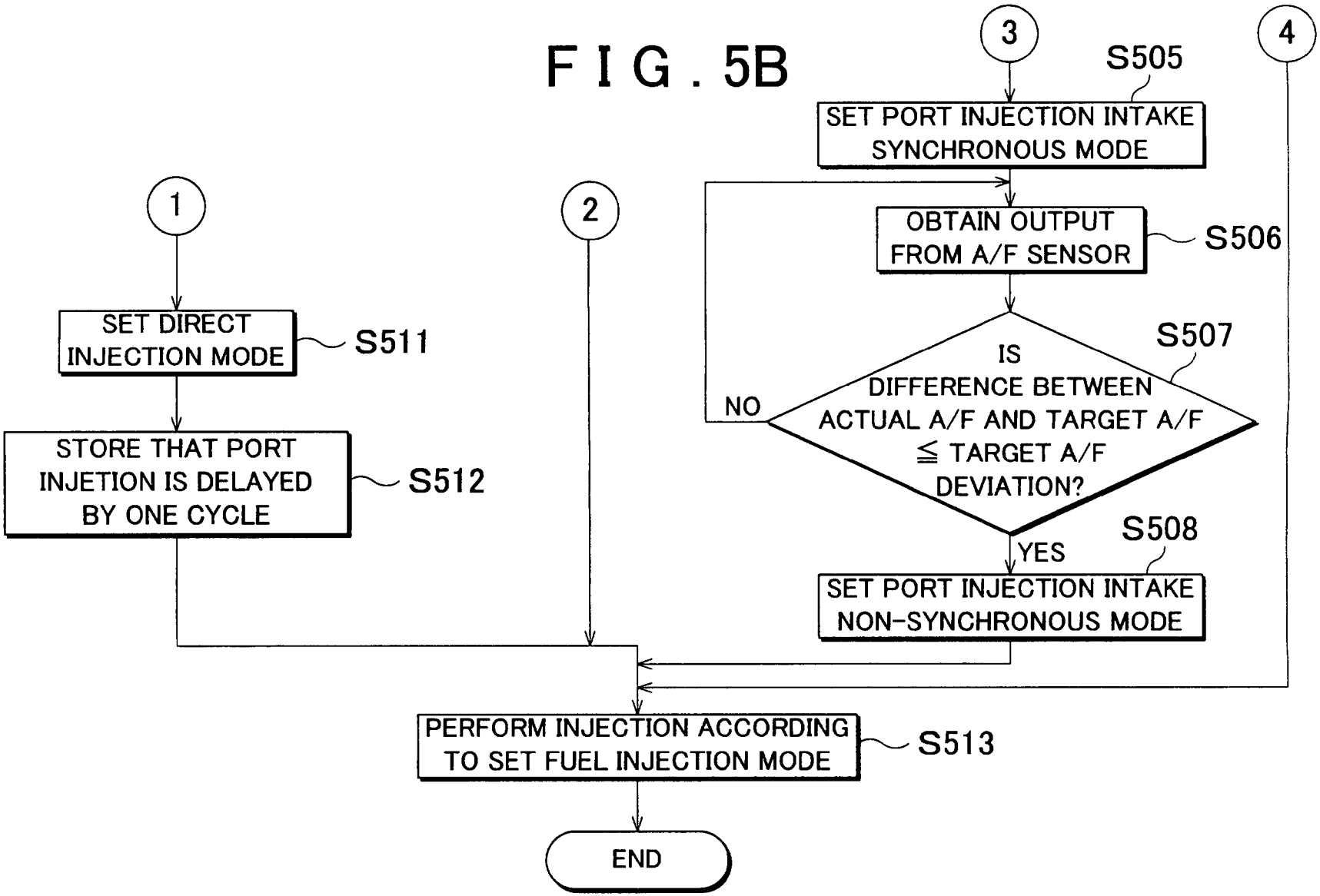

Next, a description will be made concerning an example of a control routine of the control method of the fuel injection apparatus for an internal combustion engine according to the second embodiment of the invention, with reference to flowcharts in FIGS. 5A and 5B. When the control is started, as in the case of the above-mentioned control routine, the electronic control unit 100 determines the engine operation state and the requested region based on an engine load detected by the accelerator pedal operation amount 113 and the air flow meter 102 at predetermined intervals, and an engine rotational speed obtained by calculation performed by the crank position sensor 111.

In step S501, it is determined whether there is a request to change the region from the stratified lean region "1", in which direct injection is performed by injecting fuel from the injector 33 for cylinder injection, to the homogenous lean region "2", in which port injection is performed by injecting fuel from the injector 31 for intake port injection, or to the homogenous stoichiometric ($\lambda$=1) region "3". When it is determined in step S501 that a request to change the region has not been made ("NO" in step S501), step S502 is then performed in which the fuel injection mode is set to the direct injection mode in order to continue the direct injection, that is, the fuel injection from the injector 33 for cylinder injection. On the other hand, when it is determined in step S501 that a request to change the region has been made, namely, a request to change the fuel injection mode from the direct injection mode to the port injection mode has been made, step S503 and the following steps are performed in which a routine for minimizing fluctuation of an air-fuel ratio is performed according to a point of time at which a request to change the fuel injection mode is made for the particular cylinder. Namely, it is determined in step S503 whether the request to change the fuel injection mode is made before the port injection mode is set for the particular cylinder. When it is determined that the request is made before the port injection mode is set for the particular cylinder, step S504 is then performed in which it is determined whether there is a request for the intake synchronous mode in the intake non-synchronous injection region "2-1". When an affirmative determination is made in step S504, step S510 is then performed in which the fuel injection mode is set to the port injection intake synchronous mode as requested. On the other hand, when a negative determination is made in step S504, step S2505 is then performed in which the fuel injection mode is set to the port injection intake synchronous mode although the intake non-synchronous mode is requested. Step S506 is then performed in which an output from the air-fuel ratio (A/F) sensor 112 is obtained. In step S507, the state is maintained until the difference between the obtained A/F and a target A/F becomes smaller than a target A/F deviation. Then, step S508 is performed in which the fuel injection mode is set to the port injection intake non-synchronous mode as request. The amount of fuel adhering to the wall surface is reduced by performing the port injection intake synchronous mode at least once although the intake non-synchronous mode is request, whereby fluctuation of the air-fuel ratio when the fuel injection mode is changed is suppressed. The A/F feedback control is completed after being performed by two or three cycles, since fluctuation of the air-fuel ratio is originally small because the port injection intake synchronous mode is performed.

When it is determined in step S503 that the request to change the fuel injection mode is made after the port injection mode is set for the particular cylinder, step S509 is then performed in which whether the request is made before the direct injection mode is set. When it is determined in step S509 that the request is made before the direct injection mode is set, step S510 is then performed in which the port injection intake synchronous mode is set. On the other hand, when a negative determination is made in step S509, step S511 is then performed in which the direct injection mode is set. Further, in step S512, the information that the port injection is delayed by one cycle is stored. Then, in step S513, fuel injection according to the fuel injection mode set in step S508, step S510 or step S511 is performed.

A fuel injection apparatus and a fuel injection control method for an internal combustion engine (10) which performs a direct injection operation for injecting fuel from an injector for cylinder injection (33) into a cylinder and a port injection operation for injecting fuel from an injector for intake port injection (31) into an intake port (13). When a request to change from fuel injection from the injector for cylinder injection (33) to fuel injection from the injector for intake port injection (31) is made, the fuel injection mode is set to a fuel injection mode which can be set for a particular cylinder according to a point of time at which the changing request is made for the particular cylinder. Accordingly, transition to the optimum fuel injection mode is performed in a short time, and a required amount of air-fuel mixture can be obtained. It is therefore possible to suppress fluctuation of torque and deterioration of emission.

The invention claimed is:

1. A fuel injection apparatus for an internal combustion engine which performs a direct injection operation for injecting fuel from an injector for cylinder injection into a cylinder and a port injection operation for injecting fuel from an injector for intake port injection into an intake port, comprising:

a controller that: when a request to change a fuel injection mode from a mode of fuel injection from the injector for cylinder injection to a mode of fuel injection from the injector for intake port injection is made, changes the fuel injection mode of a particular cylinder at a point of time according to the request to change the fuel injection mode for the particular cylinder, wherein in the case where the request to change the fuel injection mode is made during a period after the port injection mode is set and before a direct injection mode is set, when a requested port injection mode is an intake synchronous injection mode, the controller changes the fuel injection mode to the mode of fuel injection from the injector for intake port injection simultaneously with the request to change the fuel injection mode, and when a requested port injection mode is an intake non-synchronous injection mode, the controller changes the fuel injection mode to the mode of fuel injection from the injector for intake port injection after one cycle has elapsed since the request to change the fuel injection mode is made.

2. The fuel injection apparatus for an internal combustion engine according to claim 1, wherein in the case where the request to change the fuel injection mode is made before the fuel injection mode is set to a port injection mode, the controller changes the fuel injection mode to the mode of fuel injection from the injector for intake port injection simultaneously with the request to change the fuel injection mode.

3. The fuel injection apparatus for an internal combustion engine according to claim 1, wherein in the case where the request to change the fuel injection modes is made after the port injection mode and the direct injection mode are set, the controller changes the fuel injection mode to the mode of fuel injection from the injector for intake port injection after one cycle has elapsed since the request to change the fuel injection mode is made.

4. A fuel injection apparatus for an internal combustion engine according to claim 1, wherein when a fuel injection mode is changed from a mode of fuel injection from the injector for cylinder injection to a mode of fuel injection from the injector for intake port injection, the controller sets the fuel injection mode to an intake synchronous injection mode until an amount of fuel adhering to a wall surface of the intake port due to port injection becomes stable.

5. A fuel injection control method for an internal combustion engine which performs a direct injection operation for injecting fuel from an injector for cylinder injection into a cylinder and a port injection operation for injecting fuel from an injector for intake port injection into an intake port, comprising the steps of:

when a request to change a fuel injection mode from a mode of fuel injection from the injector for cylinder injection to a mode of fuel injection from the injector for intake port injection is made, the fuel injection mode of a particular cylinder is changed at a point of time according to the request to change the fuel injection mode for the particular cylinder, and in the case where the request to change the fuel injection mode is made during a period after the port injection mode is set and before a direct injection mode is set, when a requested port injection mode is an intake synchronous injection mode, the fuel injection mode is changed to the mode of fuel injection from the injector for intake port injection simultaneously with the request to change the fuel injection mode, and when a requested port injection mode is an intake non-synchronous injection mode, the fuel injection mode is changed to the mode of fuel injection from the injector for intake port injection after one cycle has elapsed since the request to change the fuel injection mode is made.

6. The fuel injection control method for an internal combustion engine according to claim 5, further comprising the step of:

in the case where the request to change the fuel injection mode is made before the fuel injection mode is set to a port injection mode, the fuel injection mode is changed to the mode of fuel injection from the injector for intake port injection simultaneously with the request to change the fuel injection mode.

7. The fuel injection control method for an internal combustion engine according to claim 5, further comprising the step of:

in the case where the request to change the fuel injection modes is made after the port injection mode and the direct injection mode are set, the fuel injection mode is changed to the mode of fuel injection from the injector for intake port injection after one cycle has elapsed since the request to change the fuel injection mode is made.

8. A fuel injection control method for an internal combustion engine according to claim 5, further comprising the step of:

when a fuel injection mode is changed from a mode of fuel injection from the injector for cylinder injection to a mode of fuel injection from the injector for intake port injection, the fuel injection mode is set to an intake synchronous injection mode until an amount of fuel adhering to a wall surface of the intake port due to port injection becomes stable.

* * * * *